US007611069B2

(12) United States Patent
Clifford et al.

(10) Patent No.: US 7,611,069 B2
(45) Date of Patent: Nov. 3, 2009

(54) APPARATUS AND METHOD FOR A ROTARY ATOMIZER WITH IMPROVED PATTERN CONTROL

(75) Inventors: Scott J. Clifford, Rochester Hills, MI (US); Matthew R. Sikowski, Van Buren Township, MI (US)

(73) Assignee: Fanuc Robotics America, Inc., Rochester Hills, MI (US)

( * ) Notice: Subject to any disclaimer, the term of this patent is extended or adjusted under 35 U.S.C. 154(b) by 71 days.

(21) Appl. No.: 11/199,948

(22) Filed: Aug. 9, 2005

(65) Prior Publication Data

US 2007/0034715 A1 Feb. 15, 2007

(51) Int. Cl.
*B05B 3/02* (2006.01)
*B05B 17/04* (2006.01)

(52) U.S. Cl. ..... 239/7; 239/222.11; 239/224; 239/296; 239/297; 239/300; 239/424

(58) Field of Classification Search ..... 239/291, 239/113, 112, 224, 703, 690, 700
See application file for complete search history.

(56) References Cited

U.S. PATENT DOCUMENTS 4,601,921 A * 7/1986 Lee ..... 427/240
4,645,127 A * 2/1987 Emory et al. ..... 239/299
4,936,510 A 6/1990 Weinstein
5,078,321 A 1/1992 Davis et al.
5,106,025 A * 4/1992 Giroux et al. ..... 239/703
5,289,947 A 3/1994 Akeel et al.
5,697,559 A * 12/1997 Davis et al. ..... 239/703
6,050,499 A * 4/2000 Takayama et al. ..... 239/112
6,056,215 A * 5/2000 Hansinger et al. ..... 239/703
6,189,804 B1 2/2001 Vetter et al.
6,569,258 B2 5/2003 Clifford et al.
6,703,079 B2 3/2004 Clifford et al.
6,811,094 B2 * 11/2004 Kon et al. ..... 239/223
2004/0144860 A1 * 7/2004 Nolte et al. ..... 239/290

* cited by examiner

*Primary Examiner*—Dinh Q Nguyen
(74) *Attorney, Agent, or Firm*—Fraser Clemens Martin & Miller LLC; William J. Clemens

(57) ABSTRACT

An apparatus and method for forming and controlling a pattern for spraying surfaces with a fluid uses a rotary atomizer spray head having an air shaping ring with shaping air nozzles inclined in a direction of rotation of a bell cup to direct the air onto the cup surface near the cup edge. The air shape ring optimizes the shape air control to create a stable, focused pattern that minimizes robot speed while maintaining high transfer efficiency. Nozzles extending parallel to the axis of rotation of the bell cup can be provided. Selection of the shaping air flow rate produces broad, collapsed and tubular spraying patterns.

28 Claims, 8 Drawing Sheets

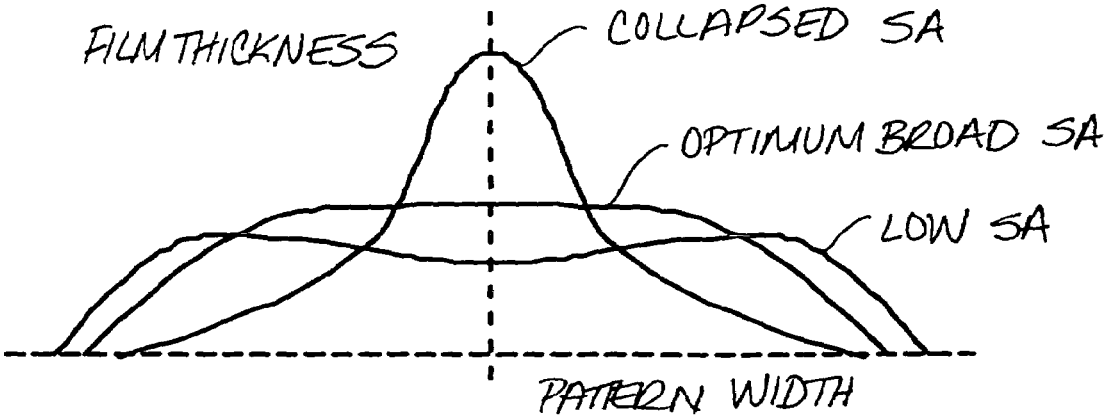
FIG - 10
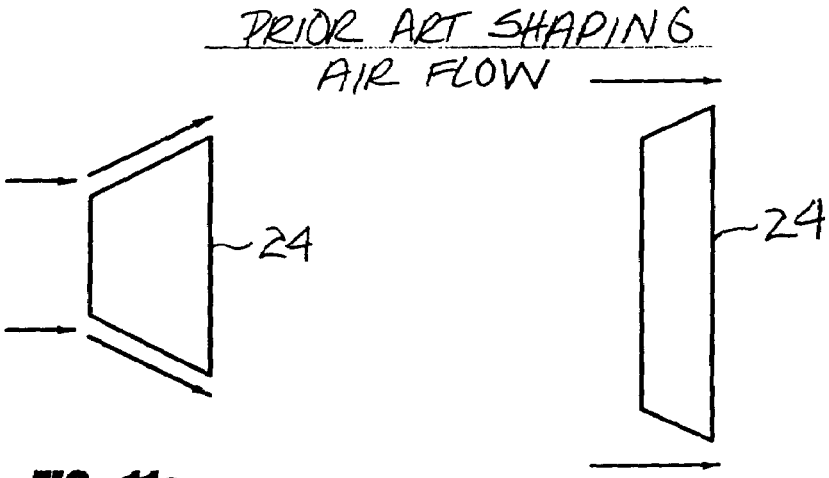
FIG - 11a
Prior Art
FIG - 11b
Prior Art

APPARATUS AND METHOD FOR A ROTARY ATOMIZER WITH IMPROVED PATTERN CONTROL

BACKGROUND OF THE INVENTION

The present invention relates generally to an apparatus and method for painting surfaces and, in particular, to an apparatus and method for forming and controlling a pattern for spraying surfaces with a fluid using a rotary atomizer spray head.

Improvements in painting automobile bodies and component parts continue to advance. In the area of painting exterior surfaces, robots with rotary atomizers are now being used in place of less flexible bell machines. Robots offer more flexibility and new approaches are offered to reduce paint consumption and improve film build uniformity. Robots have long been used for painting interior compartments of car bodies, including the engine compartment, door rings, and trunk compartment. Robots are now being outfitted with rotary atomizers in place of spray guns to further reduce paint usage and improve coverage. With these advances, the pattern control of the rotary atomizer is being adapted to optimize film build uniformity and finish quality while reducing paint consumption.

Exterior Optimization

The use of robots outfitted with rotary atomizers continues to gain popularity for painting the exterior surfaces of automobile bodies. As the trend becomes a standard for the industry, refinements in the application method continue to develop. One area of particular importance is the spray pattern geometry and painting methods described in U.S. Pat. No. 6,703,079. The velocity and direction of the shaping air imparted to the outside edge of the bell cup is the main influence on the spray pattern geometry. Higher velocities result in a smaller and more defined pattern.

Prior art apparatuses include the use of less flexible manipulators where the amount of shaping air is maintained at a low level. Consequently, the single applicator cast a large pattern covering a large surface area. The broadly cast pattern used in prior art application methods has a relatively low particle speed and largely relies on the electrostatic effect to carry the atomized droplets to the grounded surface of the car body. The thickness of the deposited paint film is susceptible to surface irregularities and the dynamics of spray booth air flow. Protrusions in the surface or the edges of the panels attract more paint due to the electrostatic effect. The slow moving particles are influenced by spray booth downdraft, which affects the paint cloud resulting in poor surface uniformity.

The broadly cast pattern is also inefficient when painting smaller panels as a large portion of the paint droplets are sprayed beyond the desired target area. This paint is deposited on parts of the car that do not require the decorative media; for example, the inside surfaces of the car or the underside surfaces of the car.

The use of a focused pattern as opposed to a broadly cast pattern can attain improved surface finish uniformity while maintaining a relatively high transfer efficiency. The increased flexibility of the robotic method permits the application of the focused pattern of charged paint droplets to be moved across the multi contoured exterior surface. In this manner, the paint is directed more specifically to the areas needed. The higher shape air setting produces a slightly higher particle velocity that minimizes the uniformity issues associated with electrostatic attraction and spray booth airflow effects. Optimization of the shape air control can create a stable focused pattern that minimizes robot speed while obtaining high transfer efficiency. The diameter of the air holes, the spacing or number of holes, the distance from the bell cup edge and the geometry of the external surface of the bell cup edge are the main factors for controlling the pattern shape.

In past practices, the shape air holes were mainly straight having either a flow vector perpendicular to the bell cup edge directed into the paint stream and not on the cup surface, or originating behind the cup with the air directed along the majority of the cup's exterior.

Shape air rings have been developed with air holes angled counter to the bell cup rotation. Optimization of the shape air ring design with holes pointing against the bell cup rotation produces dual pattern types. Lower airflow velocities produce the broadly cast pattern (also called soft pattern) while higher velocities produce the focused pattern (also called vortex pattern).

Past experimentation was conducted to change the method in which the second coat of metallic base coat paints was applied. Previously the second coat was applied with a spray gun to achieve the desired alignment of metal flakes, particularly with the flakes aligned parallel to the surface. Having a significantly higher transfer efficiency (TE), it was desirable to use a rotary applicator to perform the same task.

Modifications to the bell cup and use of air nozzles inclined against the rotational direction of the bell cup produced desired results with a significantly improved transfer efficiency (TE) when compared to a spray gun. The process of painting with nozzles inclined against the rotation of the bell cup is well known and used extensively in the industry today. Although this method provided suitable results at lower bell cup rotational speeds, the pattern would collapse into a narrow and unstable pattern at higher rotational speeds. At higher flow rates and with very viscous materials it is necessary to seek other solutions in order to achieve the desired color and surface finish required.

Interior Optimization

While the stable focused pattern is desirable for exterior applications, it is sometimes necessary to further collapse the atomized paint into a very narrow tubular spray pattern in order to deposit the paint into narrow and complex surfaces such as the interior door ring. This very narrow pattern is undesirable for exterior surfaces because it could lead to striping or very high robot movement but it is very desirable to get paint into the door hinge area. For this application, it is necessary to achieve the tubular pattern at lower bell speeds in order to have high transfer efficiency. The straight hole arrangement, with the nozzles in close proximity to the bell cup edge seems to be the most effective approach to develop the very concentrated pattern geometry.

With the straight shaping air hole alignment, several prior art approaches exist to create narrow pattern widths necessary for interior cut in applications. The approaches consist of: 1) high volume shaping air with holes directing air flow off the bell cup edge; 2) shaping air holes located significantly rearward of the bell cup edge with a high volume of air traveling along the length of the cup; and 3) small diameter bell cups that create narrow pattern widths. In all three approaches, the high volume of shaping air is necessary to collapse the pattern.

Each of the aforementioned approaches has drawbacks. With the shaping air holes directing air into the paint stream, not landing the shaping air on the bell cup edge, the high velocity air can pierce the paint pattern. Poor uniformity can occur at higher flow rates. More air is needed causing a venturi effect near the nozzles and a small portion of the paint droplets can get drawn into a circulating pattern causing secondary atomization. Shaping air located at the extreme rear of the cup requires significantly more air flow to achieve the necessary velocity to collapse the pattern into a sufficiently tight pattern for interior cut ins. Lastly, a smaller diameter bell cup must be operated at a higher bell speed, proportional to diameter, to achieve the same amount of atomization as a larger bell cup. A higher amount of shaping air is required to assist in atomization. In all cases higher shaping air velocity causes lower transfer efficiencies; moreover, higher velocities causes re-circulation leading to poorer atomization and over spray accumulation on the applicator. It is desirable to have a nozzle that uses the minimum amount of air to attain the tubular effect needed for interior cut-in type applications.

SUMMARY OF THE INVENTION

The present invention concerns an apparatus and method for a rotary atomizer with improved pattern control operation for both exterior and interior applications. While a single nozzle can be designed to produce the acceptable performance to cover both applications, it is unlikely that a single nozzle can offer optimized benefits of a dual ring device.

The apparatus and method utilize both straight and inclined air nozzles relative to the bell cup edge with the air directed onto the cup surface near the cup edge. This provides benefits of improved pattern control.

The present invention optimizes the shape air control to create a stable, focused pattern for exterior painting that minimizes robot speed while maintaining high transfer efficiency. The invention offers improved transfer efficiency and quality performance compared to prior art nozzles by directing the shape air in the direction of rotation of the bell cup. While the straight hole approach is not novel, combining a ring of straight holes with a secondary ring of holes inclined in the direction of bell cup rotation is a new approach to achieving the benefits of both application methods with the same applicator.

An optimum pattern and transfer efficiency is reached for each desired application, broad, focused, or tubular, by the particular combination of hole size, inclination angle, distance from bell cup edge, and geometry of the bell cup edge. The new air shape ring of the present invention is highly efficient with respect to air consumption. Consequently, desired pattern control is achieved at relatively low shape air velocities. The broad pattern is generally achieved with the inclined holes in the 50-180 slpm (standardized liters per minute) and the collapsed pattern is achieved in the 240-400 slpm range of shaping air flow. The straight hole arrangement can achieve the tubular pattern with 200-400 slpm.

The result is significant for exterior applications as both spraying methods, broad and focused, can be achieved merely by adjusting the shaping air flow rate, and the shape air direction relative to the bell cup rotation. In addition, a second ring of straight holes can be added to develop the tubular shaped spray pattern needed for interior applications. The air flow of the two rings could have separate flow control circuits.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 10 is a schematic representation of the resulting pattern width and film thickness according to the present invention;

FIGS. 11*a* and 11*b* are prior art schematic representations of typical shaping air flow;

DESCRIPTION OF THE PREFERRED EMBODIMENT

Figure 1:
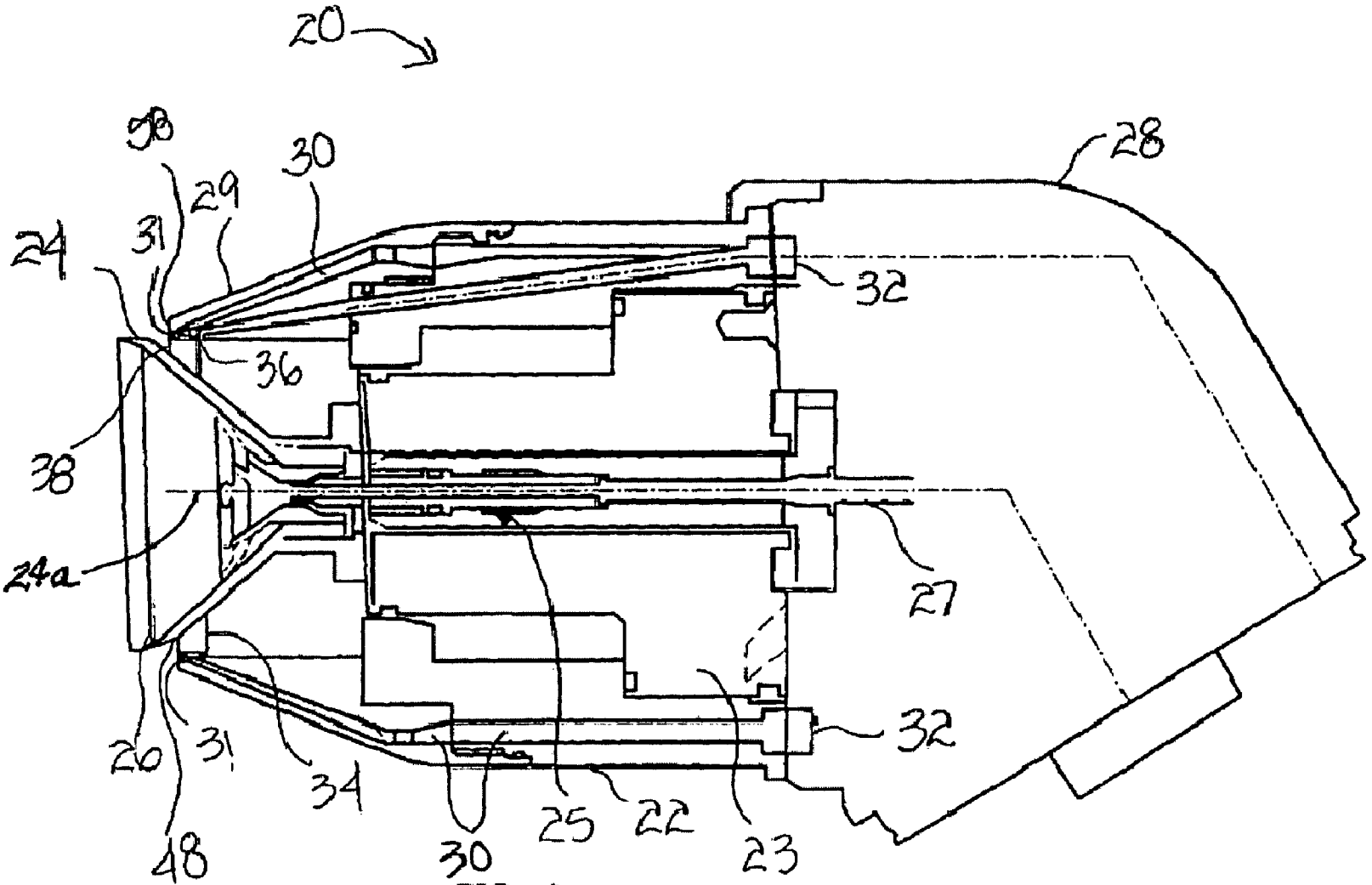
FIG. 1 is a side elevation view in partial cross section of a bell atomizer spray head a shape air ring according to the present invention.
Figure 2:
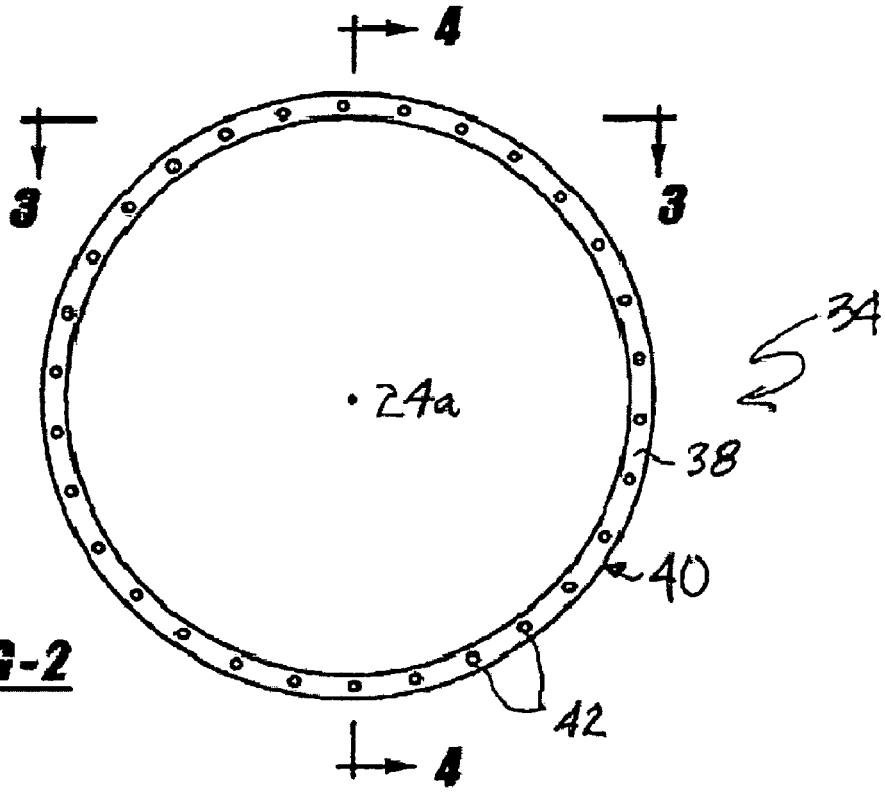
FIG. 2 is front view of a preferred embodiment of the shape air ring according to the present invention.
Figure 3:
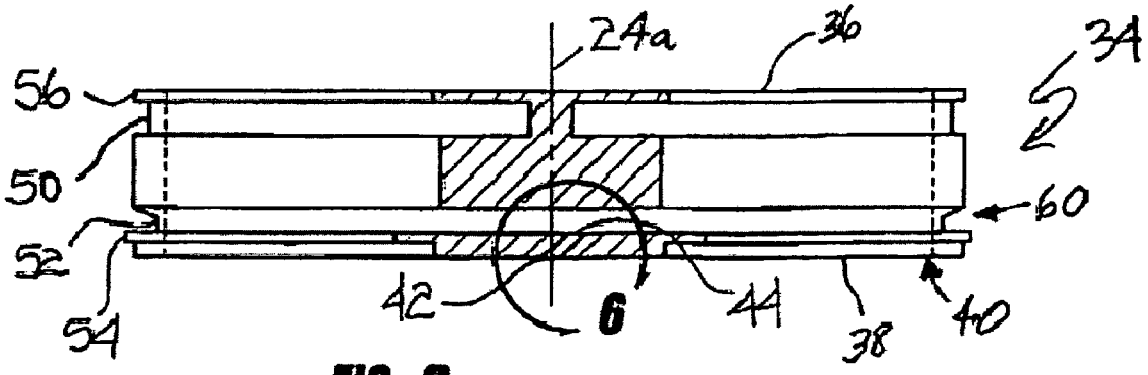
FIG. 3 is a an enlarged side view in partial section of the apparatus shown in FIG. 2 taken along the line 3-3.
Figure 4:
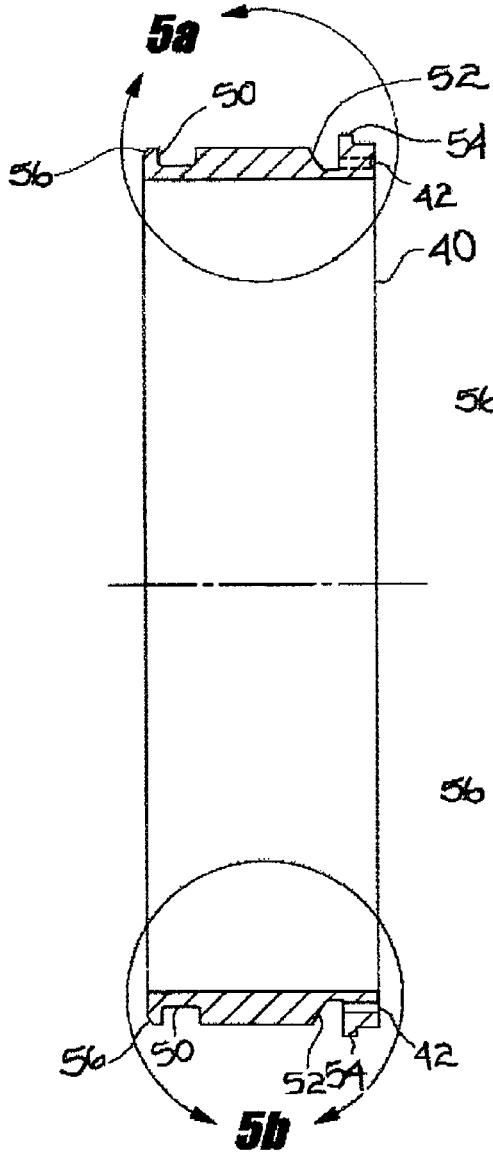
FIG. 4 is an enlarged cross-sectional edge view of the apparatus shown in FIG. 2 taken alone line 4-4.
Figure 5A:
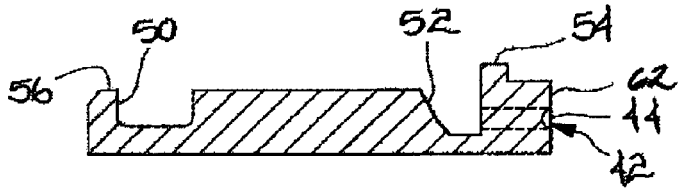
FIG. 5*a* is an enlarged view of the shape air ring edge shown in FIG. 4.
Figure 5B:
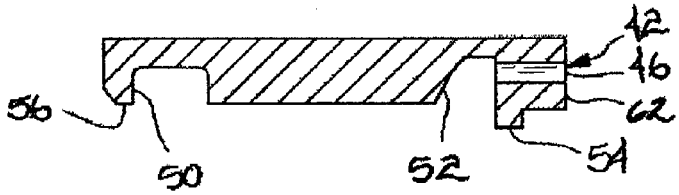
FIG. 5*b* is an enlarged view of the shape air ring edge shown in FIG. 4.
Figure 6:
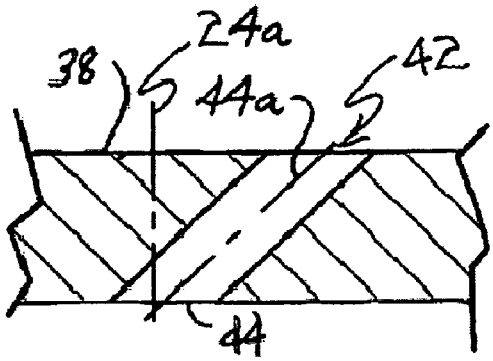
FIG. 6 is an enlarged view of a first preferred embodiment of the nozzle shown in FIG. 3.
Figure 7:
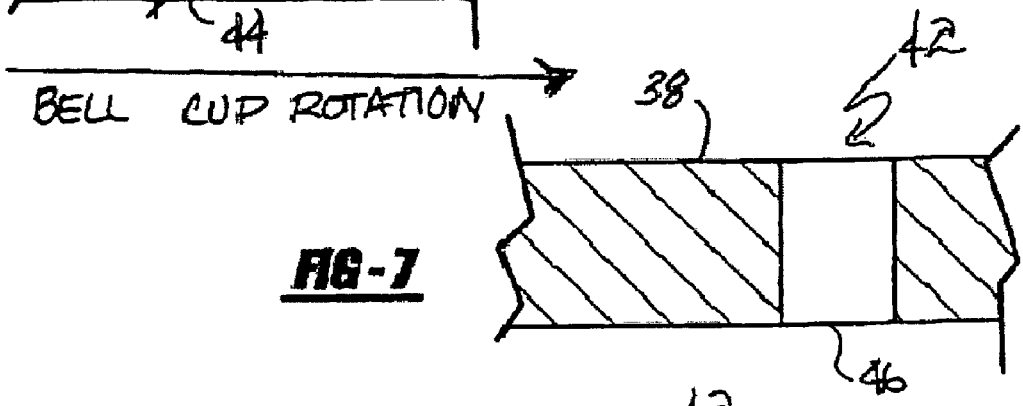
FIG. 7 is an enlarged view of a second preferred embodiment of the nozzle shown in FIG. 3.
Figure 8:
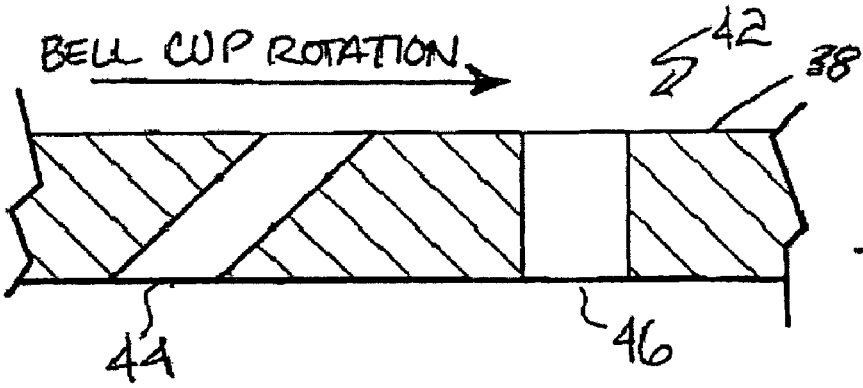
FIG. 8 is an enlarged view of a third preferred embodiment of the nozzle shown in FIG. 3.

Referring now to FIG. 1, a bell atomizer spray head is indicated generally at 20 adapted to be mounted at the end of a robot arm. The bell atomizer spray head 20 includes a generally cylindrical outer cover, shroud or housing 22 that encloses a drive motor 23 such as a magnetic air bearing turbine. The turbine 23 drives in rotation a generally frustroconical atomizing bell cup 24 positioned in an open end of the cover 22. The atomizing bell cup 24 is supplied with paint through a central opening connected to a fluid injector 25 that extends through the turbine 23. When the atomizing bell cup 24 is rotated by the turbine 23 and paint is supplied through the injector 25 through a supply line 27, a fluid stream (not shown) enters the center of the bell cup 24 and covers an interior surface flowing to an outer edge 26 where the paint is released into the surrounding air in atomized form.

The spray head 20 is connected to a robot wrist 28 through which the supply line 27 extends. The robot wrist 28 may be angled, as shown, or it may be a straight connector (not shown.). The robot wrist 28 is typically attached to a robot arm (not shown). The supply line 27 can be connected to a paint supply, such as a canister (not shown) carried by the robot arm. Alternatively, the supply line 27 is connected to a remote manifold (not shown) connected to storage tanks of a single type of or different color paints.

Attached to a forward end of the cover 22 is a generally tubular shaping air assembly 29 that terminates adjacent an outer surface of the bell cup 24 near the outer edge 26 thereof. A plurality of air passages 30 are formed in the assembly 29 each having at one end a hole or slot outlet 31 facing the outer surface of the bell 24 and directed generally toward the edge 26. The shaping air passages 30 are connected to a shaping air supply line 32 that extends through the robot wrist 28 to a shaping air supply (not shown) providing pressured air. The shaping air exiting the outlets 31 passes through a shaping air ring apparatus 34, directing the atomized paint in a desired pattern toward the object to be painted. The shaping air ring apparatus 34 is secured at one end 36 to the housing 22 and the opposite end 38 extends toward the annular outer edge 26 of the bell cup 24. The shaping air ring apparatus 34 is preferably located at a point rearward of the bell cup annular outer edge 26.

With reference to FIGS. 2-8, the shaping air ring apparatus 34 of the present invention is there shown and includes an annular hollow shaping air ring 40 having at least one nozzle 42 with a hole 44 extending from an inlet to an outlet for directing shaping air from the housing 22 through the nozzle 42 toward the annular outer edge 26 of the bell cup 24. The nozzle 42 is preferably positioned adjacent an exterior surface 48 and rearwardly of the outer edge 26 (FIG. 1) of the bell cup 24. The bell cup 24 and the shaping air ring apparatus 34 have a common central axis 24*a* as shown in FIG. 1 which is the axis of rotation of the bell cup 24.

The hollow air shaping ring 40 is preferably formed to fit adjacent the slot outlets 31 provided about the air passages 30 of the tubular shaping air assembly 29. The hollow air shaping ring 40 is provided with a square slot 50 and an angled slot 52 for slip fining about slot outlets 31. The outer edge 54 of the ring 40 is larger than the inner edge 56 of the ring 40 to provide a tight fit about the outwardly angled edge 58 (FIG. 1) of the tubular shaping air assembly 29. At least one air passageway 60 is provided by the groove 52 for receiving shaping air from shaping air passages 30 connected to the shaping air supply line 32. The air passageway 60 directs the shaping air about the hollow air shaping ring 40 and through the nozzle 42. The nozzle 42 is preferably one of a plurality of a set number of nozzles 42 spaced in a set pattern along the hollow air shaping ring 40. Air passageway 60 acts as a manifold 61 (FIG. 9) for supplying air to the set number of nozzles 42.

With reference to FIGS. 6-9, in a first preferred embodiment, the nozzle 42 is the hole 44 inclined in the rotation direction of the bell cup 24 such that a longitudinal axis 44*a* (Fit 6) of the hole 44 is not parallel to the central axis 24*a* shown in FIG. 1. Alternatively, the nozzle 42 may preferably be a hole 46 extending perpendicular to the rotation direction of the bell cup 24. Other additional embodiments include alternating angled 44 and perpendicular 46 nozzles, or two separate and distinct hollow air shaping rings 40, where a first annular ring 40' is secured at one end to the housing 22 and the opposite end extends toward the bell cup 24. This first ring 40' includes nozzles 42 extending in one direction, perpendicular or angled while a second ring 40", secured to the interior of the first ring 40', includes nozzles 42 extending in the opposing direction set by the first ring 40∝. Therefore, if the first ring 40' includes nozzles 42 with the holes 46 extending perpendicular to the rotation of the bell cup 24, then the second ring 40" preferably includes nozzles 42 with the holes 44 extending at an angle to the rotation direction of the bell cup 24. With all of the embodiments, the angle of the nozzle 42 may be in either direction of incline from the plane of the exterior surface 38 of the hollow air shaping ring 40 regardless of the direction of rotation of the bell cup 24.

Figure 9:
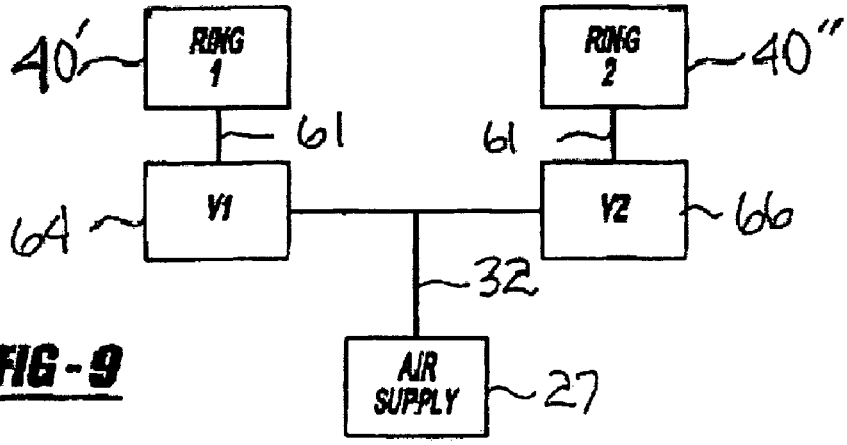
FIG. 9 is a schematic representation of a preferred method according to the present invention.

FIG. 9 illustrates a method for switching between the shaping air formed by first ring 40' and second ring 40". The air supply 27 is provided through the shaping air supply line 32 to valves 64, 66. Valve 64 supplies the shaping air to the first air ring 40' via its manifold 61. Valve 66 supplies the shaping air to the second air ring 40" via its manifold 61. In this way, one or both rings 40', 40" may be activated to form and control the desired spray pattern.

The preferred method for forming and controlling a pattern for spraying surfaces with a fluid using a rotary atomizer spray head 20 of the present invention is to provide a shaping air ring 40 with at least one nozzle 42 in the shaping air ring assembly of the rotary atomizer spray head. The nozzle 42 is preferably positioned adjacent the exterior surface and the outer edge 26 of the bell cup 24 of the rotary atomizer spray head. To optimize the pattern width for the surface to be sprayed, the outer diameter of the annual outer edge 26 of the bell cup 24 is adjusted along with the outer diameter of the nozzle 42 in the air shaping ring 40.

In a preferred embodiment, the shaping air ring 40 is located at a point rearward from the bell cup edge 26 of 2 mm. In a second preferred embodiment the shaping air ring 40 is located at a point rearward from the bell cup edge 26 of 20 mm. Depending on the preferred pattern, the shaping air ring 40 is preferably located at a point rearward from the bell cup edge 26 anywhere in the range of 2 to 20 mm with the nozzle hole diameters ranging from 0.4 to 1.0 mm and the bell cup diameter ranging between 40 mm to 120 mm.

Determining alignment of the nozzle 42 relative to the horizontal edge 62 and the rotation of the bell cup 24 is necessary for optimum surface finish uniformity relative to the type of surface to be painted—whether an interior surface generally, or an edge surface, such as an automotive door edge specifically. In a preferred embodiment, the alignment of the nozzle may be perpendicular to the horizontal edge and rotation of the bell cup. Alternatively, the nozzle may be angled from the horizontal edge in either direction. In still another preferred embodiment, the shaping air ring 40 may include both perpendicular and angled nozzles. Additionally, two air rings may be provided, 40', 40", each ring having opposite nozzle shapes, providing alternate use of an angled or perpendicular air shaping or simultaneous use of both air shaping flows.

In a preferred embodiment, the number of nozzles forming a set about the air shaping ring of the present invention is within a range of 30 to 120 per ring with a preferred shaping air rate between 50 to 1000 slpm.

With reference to FIGS. 10-13, shaping air flow and resulting pattern width of fluid relative to film thickness are there shown. As previously discussed above, prior art shaping air flow shape air holes were mainly straight having a flow vector perpendicular to the bell cup edge directed into the paint stream and not on the cup surface, or originating behind the cup with the air directed along the majority of the cup's exterior as shown in FIGS. 11*a* and 11*b*.

Figure 12:
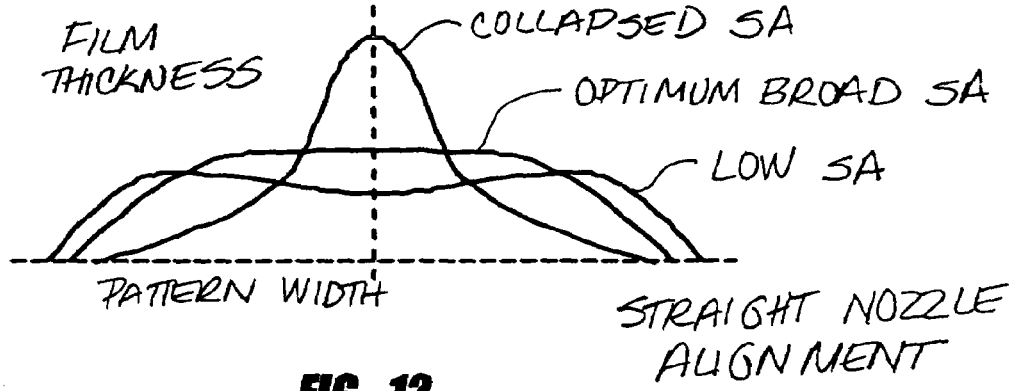
FIG - 12 Prior Art
FIGS. 12 and 13 are prior art schematic representations of the resulting pattern width and film thickness of the typical shaping air flow shown in FIGS. 11*a* and 11*b*, respectively.

The progression of shaping air velocity for prior art straight nozzle alignment is shown in FIG. 12. This prior art shaping air flow results in the film build geometry shown. Low shaping air (SA) produces a wide pattern with some concavity in the center. As the shape air is increased an optimum broad pattern is attained. A further increase to the shape air velocity collapses the pattern and produces a center-weighted pattern. Too much paint in the center of the pattern is not optimal. Even narrow overlapping will produce a nonuniform film build. Moreover, tight overlap requires a high robot speed that has an adverse effect on the pattern stability.

Figure 13:
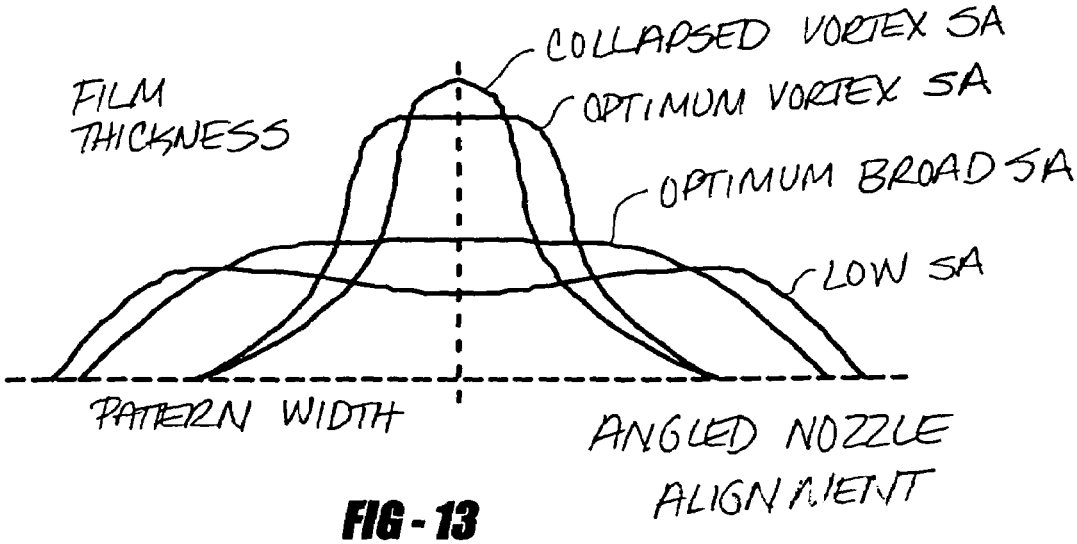
FIG - 13 Prior Art
Figure 14A:
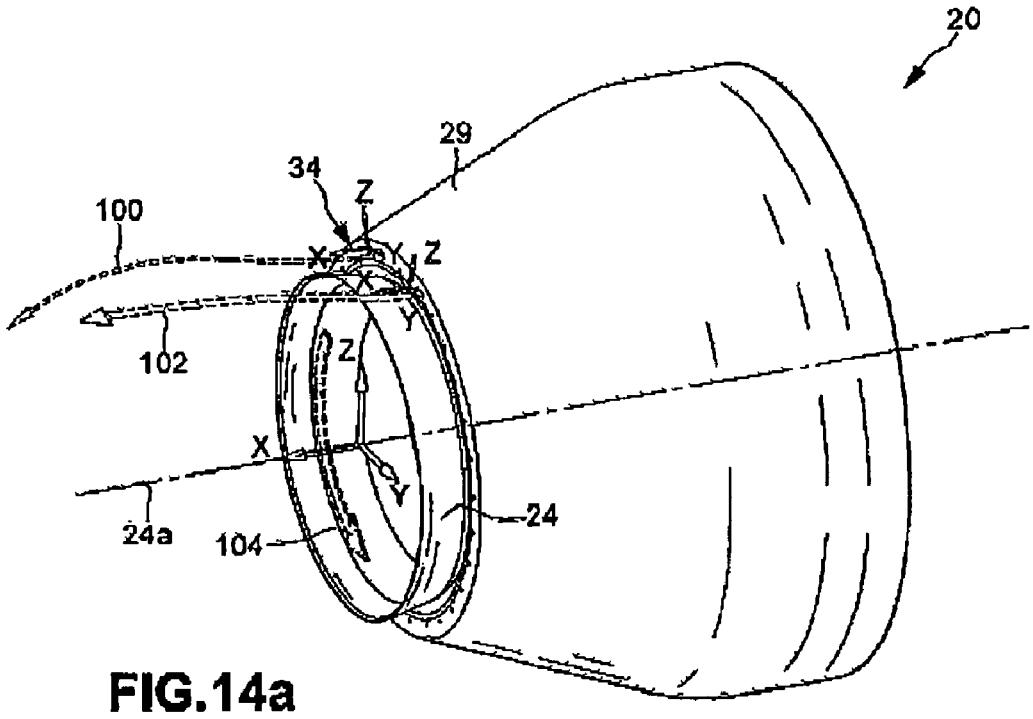
FIG. 14*a* to 14*c* are a front perspective view, a front elevational view, and a top plan view of the bell atomizer spray head and shaping air ring shown in FIG. 1, further showing a right handed triad, base coordinate system for defining the orientation of the nozzles and resulting shaping air flows.
Figure 14B:
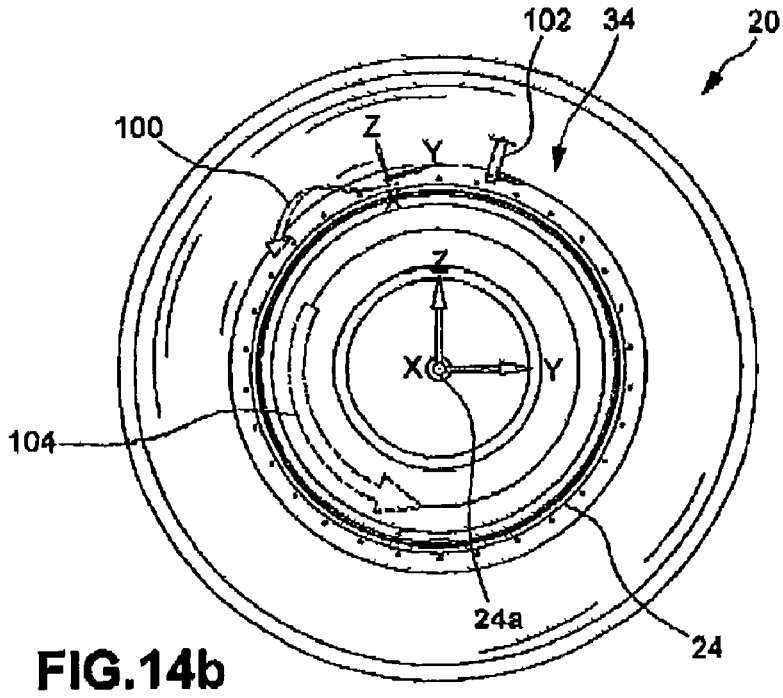
Figure 14C:
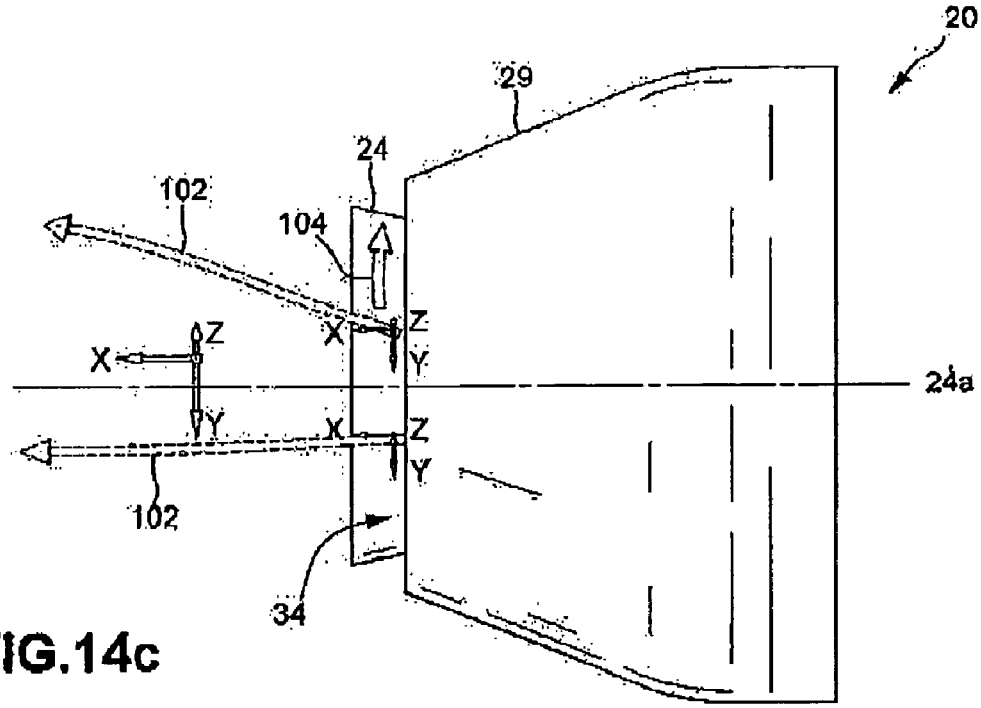
Figure 15:
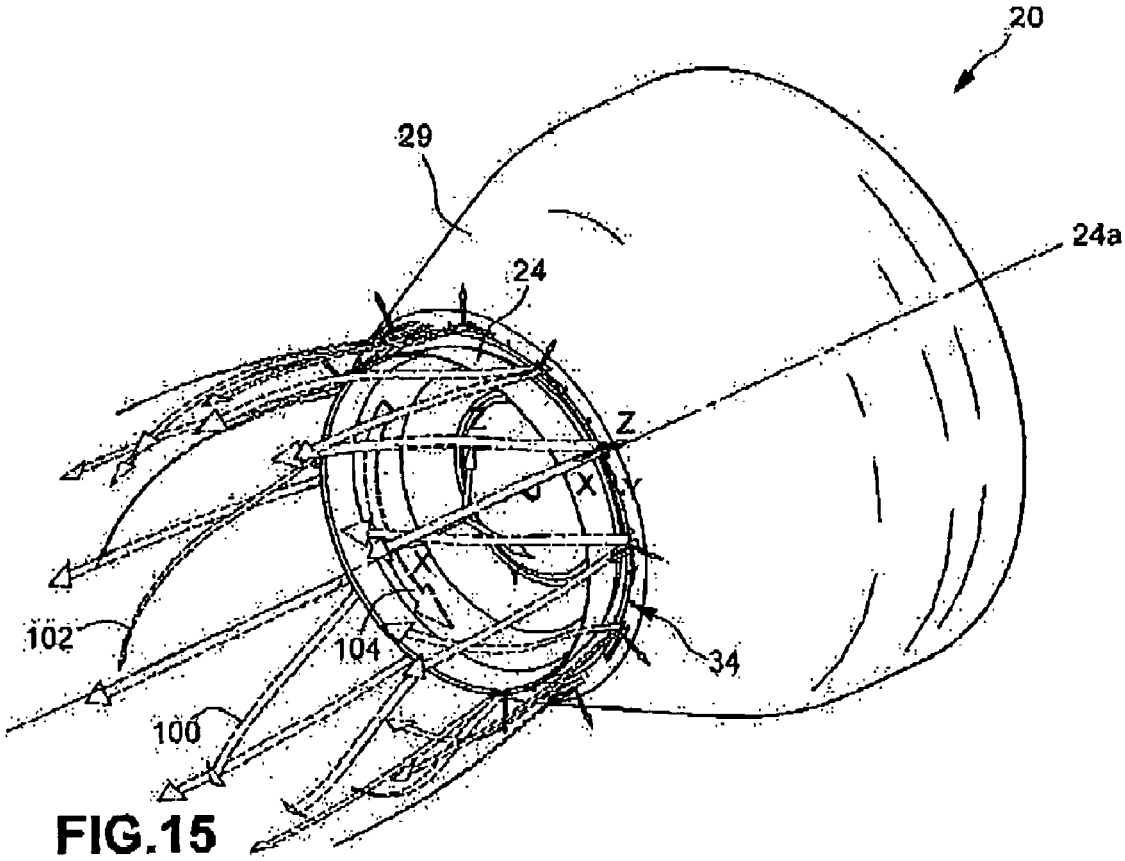
FIG. 15 is a front perspective view of the bell atomizer spray head and shaping air ring shown in FIG. 1, further showing a plurality of angled air shaping flows and a plurality of parallel air shaping flows.

The progression of shaping air velocity for prior art angled nozzle alignment is shown in FIG. 13. This prior art shaping results in this method produced a higher transfer efficiency than the prior straight nozzle alignment but can only be used with a broadly cast pattern.

The present invention of shaping air velocity for both straight and angled nozzle alignment is shown in FIG. 10. Placing the shaping air nozzles in close proximity and perpendicular to the bell cup edge such that the air impacts the cup near the edge and travels along the cup surface to produce less turbulence and circulation at the forward portion of the rotary atomizer. With the ability to optimize the desired pattern, a more stable collapsed pattern with a wider flat top results. The transfer efficiency of the collapsed pattern is nearly the same as the softer broadly cast pattern, while successfully combating the adverse effects of spray booth down draft, varying part position, fatty edges, and complex surface geometry. Additionally, the geometry of the collapsed pattern does not change over a wide range of shaping air flow, fluid flow, and bell rotational speed settings. This is ideal for reciprocating robot type painting methods where a change in process settings did not change the pattern width and the overlap remains constant. Advantageously, the robot path trajectory did not need to be changed over a wide window of process settings.

Empirical testing of numerous combinations of hole size, spacing, number of holes, inclination angle, distance rearward and outward from bell cup edge revealed that a tighter pattern could be achieved at lower bell speeds with a large diameter cup. As the pattern width is optimized for the interior surfaces, fluid flow rates could be significantly decreased. In lab testing a comparison of a prior art application and this invention was conducted. A fluid flow rate decrease of ~20% was realized. This optimal pattern width can be reproduced successfully for improved surface finish uniformity while maintaining high transfer efficiency of a rotary atomizer by adjusting the hole diameter of the nozzle, the angle of the nozzle to the bell cup rotation, the location of the nozzle to the bell cup, the number of nozzles, single or multiple array of nozzles, and the bell cup diameter and rotation result in significantly lower fluid flow rates than prior art applications.

With reference to FIGS. 14*a*-14*c* and FIG. 15, the air assembly 29 of the bell atomizer spray head 20 is shown in operation and forming at least one angled shaping air flow 100 and at least one parallel shaping air flow 102. The angled shaping air flows 100 are farmed by the nozzles 42 of the shaping air ring 34, e.g., the hollow shaping air ring 40, that are inclined in a predetermined rotation direction 104 of the bell cup 24. The parallel shaping air flows 102 are formed by the nozzles 42 of the shaping air ring 34 that extend perpendicular to the rotation direction 104 of the bell cup 24. The parallel shaping air flows 102 are oriented parallel with the axis of rotation 24*a* of the bell cup 24. The nozzles 42 are arranged in the shaping air ring 34 outwardly from the axis of rotation 24*a* of the bell cup 24. The axis of rotation 24*a* of the bell cup 24 is a longitudinal axis of the bell cup 24, for example. It should be appreciated that the angled shaping air flows 100 may be used alone or in conjunction with the parallel shaping air flows 102 within the scope of the present disclosure.

As a nonlimiting example, the nozzles 42 and their corresponding angled and parallel shaping air flows 100, 102 may be defined by a base coordinate system (right handed triad) that is placed on the longitudinal axis of each of the nozzles 42 of the shaping air ring 34, with an origin in the sane plane as the outlet of each of the nozzles 42. The X-axis of the base coordinate system extends positively outward from the outlet, parallel with the axis of rotation 24*a* of the bell cup 24, and away from the air assembly 29. The Z-axis extends positively away from the outlets of the nozzles 42 and perpendicular to the axis of rotation 24*a* of the bell cup 24. The Y-axis is orthogonal to the X- and Z-axes.

One of ordinary skill in the art understands that, where the base coordinate system (right handed triad) is employed to describe the orientation of the nozzles 42, each of the nozzles 42 angled in the predetermined direction of rotation 104 of the bell cup 24 may be defined by the hole 44 extending from the outlet to the inlet in a −X, +Y direction. Stated otherwise, each of the nozzles 42 angled in the predetermined direction of rotation 104 of the bell cup 24 has a +X, −Y orientation from the inlet end to the outlet end of the nozzle 42. Each of the nozzles 42 that extend parallel to the axis of rotation 104 of the bell cup may be defined by the hole 46 oriented in only the +X direction from the inlet end to the outlet end.

The angled and parallel shaping air flows 100, 102 may be defined by fluid vectors with origins at the outlets of the nozzles 42. In particular, the angled shaping air flows 100 formed by each of the nozzles 42 angled in the predetermined direction of rotation 104 of the bell cup 24 may be defined by fluid vectors extending outwardly from the outlets of the nozzles 42 to points that are in the +X, −Y direction. The parallel shaping air flows 102 formed by the nozzles 42 that extend perpendicular to the rotation direction 104 and parallel of the axis of rotation 24*a* of the bell cup 24 may be defined by fluid vectors extending outwardly from the outlets of the nozzles 42 to points that are only in the +X direction. The patterns for spraying surfaces with a fluid using a rotary atomizer spray head 20 may thereby be formed and controlled.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for forming and controlling a pattern for spraying surfaces with a fluid using a rotary atomizer spray head comprising the steps of:

a. providing a shaping air assembly connected to a supply of pressured air and having an open end;

b. rotatably mounting a bell cup in the open end of the shaping air assembly on an axis of rotation, wherein the axis of rotation is a longitudinal axis of the bell cup;

c. mounting a shaping air ring with a plurality of nozzles in the open end of the shaping air assembly surrounding the bell cup and adjacent an outer edge of the bell cup, the nozzles each having an inlet end for receiving air from the source of pressured air and an outlet for directing a flow of shaping air past the outer edge of the bell cup, wherein each of the plurality of nozzles have a right handed triad, base coordinate system that is placed on the longitudinal axis of the nozzle with an origin in the same plane as an outlet of the nozzle, the base coordinate system including an X-axis extending positively outward from the outlet of the nozzle, parallel with the axis of rotation of the bell cup, and away from the tubular housing, a Z-axis extending positively away from the outlet of the nozzle and perpendicular to the axis of rotation of the bell cup, and a Y-axis orthogonal to the X-axis and the Z-axis, at least one of the nozzles being angled from the inlet end to the outlet end in a predetermined direction of rotation of the bell cup, wherein a longitudinal axis of the at least one nozzle is not parallel to the axis of rotation of the bell cup, wherein the at least one nozzle extends from the inlet end to the outlet end in a +X and a −Y direction; and d. rotating the bell cup in the predetermined direction of rotation while supplying a fluid to be sprayed to the bell cup to maintain a high transfer efficiency and improved surface finish uniformity of the fluid.

2. The method according to claim 1 including at least one of the steps of:

e. selecting the angle from a range of angles;

f. selecting a diameter of the outlet end of the at least one nozzle from a range of nozzle diameters;

g. selecting a location for the at least one nozzle outlet end at a point in a range of points rearward of and adjacent to the bell cup outer edge;

h. selecting a number of the nozzles from a range of a total number of nozzles;

i. selecting an outer diameter of the outer edge of the bell cup from a range of outer diameters; and j. selecting a flow rate forte shaping air from a range of flow rates.

3. The method according to claim 2 wherein the range of angles is from 10° to 45°.

4. The method according to claim 2 wherein the range of the diameter of the outlet end of the at least one nozzle is from 0.4 mm to 1.0 mm.

5. The method according to claim 2 wherein the range of the location of the at least one nozzle outlet is from 2 mm to 20 mm rearward of the bell cup outer edge.

6. The method according to claim 2 wherein the range of the number of nozzles is from 30 to 120 nozzles.

7. The method according to claim 2 wherein the range of the outer diameter of the outer edge of the bell cup is from 40 mm to 120 mm.

8. The method according to claim 2 wherein the range of the flow rate is from 50 slpm to 1000 slpm.

9. The method according to claim 1 wherein each of said nozzles is angled toward the predetermined direction of rotation and including a step of discharging the shaping air from said nozzles in a range of from 50 slpm to 180 slpm to form a broad pattern of the fluid being sprayed.

10. The method according to claim 1 wherein each of said nozzles is angled toward the predetermined direction of rotation and including a step of discharging the shaping air from said nozzles in a range of from 240 slpm to 400 slpm to form a collapsed pattern of the fluid being sprayed.

11. The method according to claim 1, wherein at least another one of the nozzles extends generally parallel to the axis of rotation from the inlet end to the outlet end.

12. The method according to claim 11 including a step of discharging the shaping air from the straight nozzles in a range of from 200 slpm to 400 slpm to form a tubular pattern of the fluid being sprayed.

13. An apparatus for forming and controlling a pattern for spraying surfaces with a fluid using a rotary atomizer spray head comprising:

a tubular housing having an open end;

a bell cup rotatably supported in said open end of said housing and having an outer surface terminating in an annular edge from which the fluid is thrown by centrifugal force for atomization;

a motor for rotating said bell cup in a predetermined direction about an axis of rotation, wherein the axis of rotation is a longitudinal axis of the bell cup; and an annular shaping air ring secured to said housing at said open end adjacent said annular edge and including a plurality of nozzles for directing shaping air past said annular edge of said bell cup, each said nozzle having an inlet end connected to a source of shaping air and an outlet end discharging the shaping air, wherein each of the plurality of nozzles have a right handed triad, base coordinate system that is placed on the longitudinal axis of the nozzle with an origin in the same plane as an outlet of the nozzle, the base coordinate system including an X-axis extending positively outward from the outlet of the nozzle, parallel with the axis of rotation of the bell cup, and away from the tubular housing, a Z-axis extending positively away from the outlet of the nozzle and perpendicular to the axis of rotation of the bell cup, and a Y-axis orthogonal to the X-axis and the Z-axis, and at least a first group of said nozzles being angled from said inlet end to said outlet end in said predetermined direction of rotation of said bell cup, wherein a longitudinal axis of each said nozzle of said first group is not parallel to a longitudinal axis of said bell cup whereby the shaping air discharged from said nozzles reduces turbulence and cleaning frequency of the spray head, wherein each of the first group of nozzles extend from the inlet end to the outlet end in a +X and a −Y direction.

14. The apparatus according to claim 13 wherein said nozzles are angled in a range from 10° to 45°.

15. The apparatus according to claim 13 wherein said nozzles have an outlet end diameter in a range from 0.4 mm to 1.0 mm.

16. The apparatus according to claim 13 wherein said outlet ends of said nozzles are located rearward from said annular edge in a range from 2 mm to 20 mm.

17. The apparatus according to claim 13 wherein the plurality of said nozzles is in a range from 30 to 120.

18. The apparatus according to claim 13 wherein said annular edge has a diameter in a range of from 40 mm to 120 mm.

19. The apparatus according to claim 13 wherein said nozzles are formed to produce a shaping air flow rate in a range from 50 slpm to 1000 slpm.

20. The apparatus according to claim 13, wherein the plurality of nozzles for directing shaping air past said annular edge of said bell cup includes at least a second group of said nozzles each having a longitudinal axis extending in a direction generally parallel to said axis of rotation.

21. The apparatus according to claim 13, wherein the tubular housing includes a shaping air passage connected to a shaping air supply line and having a slot outlet at one end facing an outer surface of the bell cup, and the annular shaping air ring includes an air passageway disposed along an outer edge of the annular shaping air ring for receiving shaping air from the shaping air passage, the nozzles in fluid communication with the air passageway.

22. The apparatus according to claim 21, wherein the air passageway is an angled slot formed in a peripheral edge of the annular shaping air ring, the angled slot slip fining with the slot outlet.

23. The apparatus according to claim 21, wherein the outer edge of the annular shaping air ring is larger than an inner edge of the annular shaping air ring to provide a tight fit about an outwardly angled edge of the open end of the tubular housing.

24. The apparatus according to claim 13 wherein each of the first group of nozzles is configured to provide an angled shaping air flow defined by a fluid vector extending outwardly from the outlet end of the nozzle to a point that is in the +X and −Y direction.

25. The apparatus according to claim 13, wherein said shaping air ring includes a second group of said nozzles extending generally parallel to said axis of rotation from an inlet end to an outlet end, wherein each of the second group of nozzles extend from the inlet end to the outlet end in only a +X direction.

26. The apparatus according to claim 25, wherein each of the second group of nozzles is configured to provide a perpendicular shaping air flow defined by a fluid vector extending outwardly from the outlet end of the nozzle to a point that is only in the +X direction.

27. An apparatus for forming and controlling a pattern for spraying surfaces with a fluid using a rotary atomizer spray head comprising:

a tubular housing having an open end;

a bell cup rotatably supported in said open end of said housing and having an outer surface terminating in an annular edge from which the fluid is thrown by centrifugal force for atomization;

a motor for rotating said bell cup in a predetermined direction about an axis of rotation, wherein the axis of rotation is a longitudinal axis of the bell cup; and an annular shaping air ring secured to said housing at said open end adjacent said annular edge and including a plurality of nozzles for directing shaping air past said annular edge of said bell cup, each said nozzle having an inlet end for connection to a source of shaping air and an outlet end discharging the shaping air, wherein each of the plurality of nozzles have a right handed triad, base coordinate system that is placed on the longitudinal axis of the nozzle with an origin in the same plane as an outlet of the nozzle, the base coordinate system including an X-axis extending positively outward from the outlet of the nozzle, parallel with the axis of rotation of the bell cup, and away from the tubular housing, a taxis extending positively away from the outlet of the nozzle and perpendicular to the axis of rotation of the bell cup, and a Y-axis orthogonal to the X-axis and the Z-axis, at least a second group of said nozzles each having a longitudinal axis extending in a direction generally parallel to said axis of rotation, and at least a first group of said nozzles being angled from said inlet end to said outlet end in said predetermined direction of rotation of said bell cup, wherein each said nozzle of said first group has a longitudinal axis that is not parallel to said axis of rotation, wherein each of the first group of nozzles extend from the inlet end to the outlet end in a +X and a −Y direction; and a manifold connecting the source of shaping air to said nozzles whereby the shaping air discharged from said nozzles reduces turbulence and cleaning frequency of the spray head.

28. The apparatus according to claim 27 including at least one valve for selectively connecting the source of shaping air to at least one of said first group of nozzles and said second group of nozzles.

* * * * *